US012281479B2

(12) United States Patent
Mason et al.

(10) Patent No.: US 12,281,479 B2
(45) Date of Patent: Apr. 22, 2025

(54) RAINSCREEN SUPPORT SYSTEM

(71) Applicant: Hohmann & Barnard, Inc., Hauppauge, NY (US)

(72) Inventors: Christopher Mason, Queens, NY (US); Robert Lopez, Queens, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 188 days.

(21) Appl. No.: 17/833,369

(22) Filed: Jun. 6, 2022

(65) Prior Publication Data

US 2023/0392385 A1 Dec. 7, 2023

(51) Int. Cl.
*E04F 13/08* (2006.01)

(52) U.S. Cl.
CPC ..... *E04F 13/0805* (2013.01)

(58) Field of Classification Search
CPC ..... E04F 13/0805; E04B 2002/7466; E04B 2/7437; E04B 9/18; E04B 9/34; E04B 1/7608; E04B 9/06; E04B 9/04
USPC ..... 52/235, 385, 425, 426, 483.1, 489.1, 52/489.2, 506.05, 506.06, 506.08
See application file for complete search history.

(56) References Cited

U.S. PATENT DOCUMENTS 5,816,008 A * 10/1998 Hohmann ..... E04B 1/4178 52/565
8,689,508 B2 * 4/2014 Orszulak ..... E04C 2/423 52/27
8,893,452 B2 * 11/2014 Hatzinikolas ..... E04F 13/142 52/712
9,316,004 B1 * 4/2016 Hatzinikolas ..... F16M 13/02
9,493,941 B2 * 11/2016 White ..... E04B 1/388
10,323,419 B2 * 6/2019 Hatzinikolas ..... E04F 13/0857
11,162,265 B2 * 11/2021 Hatzinikolas ..... E04F 13/142
2010/0325997 A1 * 12/2010 Scully ..... E04F 13/0805 52/489.1
2014/0325928 A1 * 11/2014 White ..... F25D 23/085 52/506.05
2016/0053494 A1 * 2/2016 White ..... E04B 1/388 52/698
2016/0153198 A1 * 6/2016 Hatzinikolas ..... E04F 13/22 52/702
2018/0283012 A1 * 10/2018 Hohmann, Jr. ..... E04F 13/081
2020/0378132 A1 * 12/2020 Hatzinikolas ..... E04F 13/0805
(Continued)

*Primary Examiner* — Brian E Glessner
*Assistant Examiner* — Adam G Barlow
(74) *Attorney, Agent, or Firm* — Andrus Intellectual Property Law, LLP

(57) ABSTRACT

A rainscreen support system includes a pair of backup wall brackets having a baseplate, an extension leg extending outwardly from and transverse to the baseplate and a fastening finger extending from an end of the finger transverse to the extension leg. The fastening fingers having a thickness. An adjustable vertical support member has a mounting leg and a transverse leg. The mounting leg has openings that correspond with and receive the fastening fingers. The openings have a width larger than the thickness of the fastening fingers. The adjustable vertical support member is installed on the fingers by positioning the member on the fingers, through the openings and lowering the support member so that the fingers rest on an inner surface of the mounting leg. The support member is adjustable toward and away from the backup wall bracket baseplate to adjust a distance between the support member and the backup wall.

16 Claims, 4 Drawing Sheets

(56) References Cited

U.S. PATENT DOCUMENTS

| | | | | |
|---|---|---|---|---|
| 2021/0238861 | A1* | 8/2021 | Osmanski | E04F 13/147 |
| 2021/0310252 | A1* | 10/2021 | Hatzinikolas | E04F 13/142 |
| 2022/0056702 | A1* | 2/2022 | Hatzinikolas | E04F 13/0862 |

* cited by examiner

RAINSCREEN SUPPORT SYSTEM

BACKGROUND

The present disclosure relates to an improved anchoring and insulation arrangement for use in conjunction with building structures having a rainscreen anchored to a backup wall. More particularly, the disclosure relates to a channel anchoring system that secures both the rainscreen and the insulation to the backup wall without compromising the insulation.

There is a move toward energy-efficient insulated veneer wall structures which has led to the need to create a highly insulated building envelope. Such an envelope separates the interior environment and the exterior environment of a cavity wall structure. The building envelope is designed to control temperature changes while maintaining structural integrity. Thermal insulation is used within the building envelope to maintain temperature and therefore restrict the formation of condensation within the cavity.

In order to maintain an energy-efficient building structure, high R-value thermal insulation is secured between the backup wall or framing of the building and the exterior covering or rainscreen. Further, for optimum performance the thermal insulation should be free of penetrations, holes and the like and should be supported between the backup wall or framing of the building and the exterior covering or rainscreen with minimal to no compression.

Further still, the rainscreen should be positioned and installed so as to prevent water incursion into the space occupied by the insulation. And, for aesthetics as well as performance, the rainscreen should be flush and plum, and each panel of the rainscreen planar with each other rainscreen panel.

Known rainscreen mounting systems include brackets having a baseplate affixed to the backup wall and an outwardly extending leg. L-shaped vertical members are affixed to the bracket legs to provide a surface to which the rainscreen is mounted.

One drawback to such a system is that the distance between the backup wall and the vertical members is fixed thus fixing or setting the distance between the backup wall and rainscreen. That is, if there are variations in the backup wall, the rainscreen mounting system cannot readily account for such variations.

Accordingly, there is a need for a rainscreen mounting system that allows for mounting the rainscreen so as to establish a space between the backup wall and the rainscreen to accommodate desired insulation. More desirably, such a system allows for adjustments to the structure to which the rainscreen is mounted so that the rainscreen panels are flush and plum, and each panel of the rainscreen is planar with each other rainscreen panel.

SUMMARY

Various embodiments of the present disclosure provide a rainscreen support system for supporting a rainscreen on a wall structure. The wall structure can have a backup wall.

The rainscreen support system includes a pair of backup wall brackets. In an embodiment, the backup wall brackets are fixed backup wall brackets. The backup wall brackets have a baseplate mountable to the backup wall, and an extension leg extending outwardly from and transverse to the baseplate. Each of the adjustable backup wall brackets has a fastening finger extending from a distal end thereof transverse to the extension leg. The fastening fingers are generally parallel to the baseplate. The fastening fingers have a thickness.

An adjustable vertical support member has a mounting leg and a transverse leg. The mounting leg has openings therein that correspond with and are configured to receive the fastening fingers. The openings have a width that is larger than the thickness of the fastening fingers.

The vertical support member is installed on the fastening fingers by positioning the vertical support member onto the fastening fingers, through the openings and lowering the vertical support member so that the fastening fingers rest on an inner surface of the mounting leg above the openings. The vertical support member is adjustable toward and away from the backup wall bracket baseplate to adjust a distance between the vertical support member and the backup wall.

In embodiments, the fastening fingers further include a locking portion extending upwardly from ends thereof. The locking portions rest on the inner surface of the mounting leg above the openings. The mounting legs can further include tabs extending rearwardly therefrom at about the openings.

In embodiments, the extension legs include a fastener opening therein for receiving a fastener to secure the vertical support member to the adjustable backup wall brackets at a desired distance between the vertical support member and the baseplates. Each backup wall bracket can include two fastening fingers.

In embodiments of the system, the pair of backup wall brackets is a first pair of backup wall brackets and the vertical support member is a first vertical support member. Such a system further includes a second pair of backup wall brackets and a second vertical support member. The second pair of backup wall brackets and the second vertical support member are spaced from the first pair of backup wall brackets and the first vertical support member.

The system can also include a horizontal support member extending between the first and second vertical support members. The horizontal support member can include cutouts at the juncture of the horizontal support member and the first and second vertical support members. In embodiments, the horizontal support member is a C-shaped channel. In embodiments, the vertical support member transverse leg can include a return bend at an end thereof.

The system may also include a backup wall bracket having a base plate and an extension leg. The backup wall bracket may be a fixed backup wall bracket. The backup wall bracket can be positioned between the pair of adjustable backup wall brackets and fastened to the vertical support member on the extension leg.

In embodiments, the system further including a third pair of adjustable support brackets and a third vertical support member. The third pair of adjustable wall brackets and the third vertical support member are spaced from the second pair of adjustable wall brackets and the second vertical support member, and the horizontal support member extends across the first, second and third vertical support members.

In such a system, the horizontal support member is a first horizontal support member and further includes a second horizontal support member extending across at least some of the first, second and third vertical support members and is spaced from the first horizontal support member.

The vertical support members can be affixed to their respective backup wall brackets to accommodate insulation between the vertical support members and the backup wall.

In embodiments, the vertical support members can be fastened to the backup wall brackets over a range of distances between the vertical support member transverse leg and the backup wall baseplate.

In another aspect, a rainscreen support system supports a rainscreen on a wall structure, which wall structure has a backup wall.

The rainscreen support system includes multiple pairs of backup wall brackets and multiple vertical support members. Each of the vertical support members is adjustably affixed to a pair of wall brackets. The system includes multiple horizontal support members, each of which extends across at least some of the vertical support members.

The vertical support members are adjustable relative to their respective backup wall brackets so that outer surfaces of at least some of the horizontal support members define a plane. The vertical support members can be affixed to respective wall brackets by fasteners.

Other aspects, objectives and advantages will become more apparent from the following detailed description when taken in conjunction with the accompanying drawings.

DETAILED DESCRIPTION

While the present disclosure is susceptible of embodiments in various forms, there is described presently preferred embodiments with the understanding that the present disclosure is to be considered an exemplification and is not intended to limit the disclosure to the specific embodiments illustrated.

Figure 1:
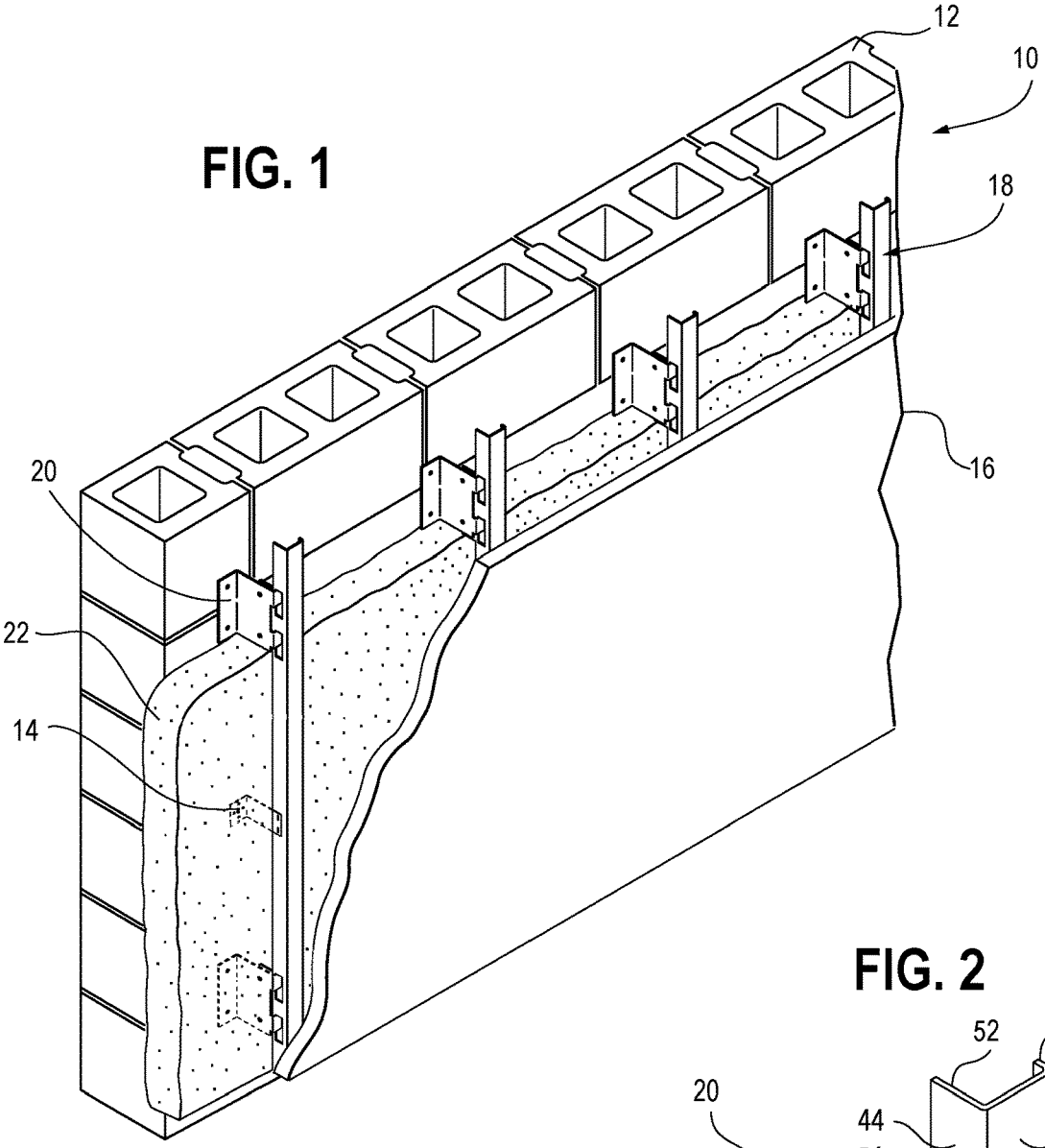
FIG. 1 is a perspective view of a wall structure showing a backup wall, insulation, a rainscreen, and a rainscreen support system according to embodiments of the present disclosure, portions of the rainscreen and insulation shown broken away for ease of illustration.
Figure 2:
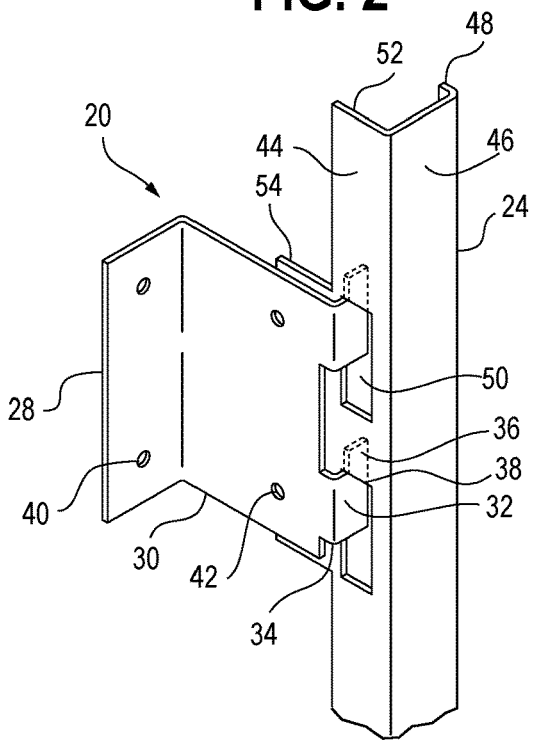
FIG. 2 is partial enlarged perspective view of a backup wall bracket and a vertical support member, showing the vertical support member engaged with the bracket.

Referring now to the figures and in particular to FIG. 1, there is shown a portion of a wall structure 10. The wall structure 10 includes a backup wall 12 which, as illustrated is a block wall. Other backup wall 12 structures will be recognized by those skilled in the art. The wall structure 10 can further include insulation 14, a rainscreen 16 and a rainscreen support system 18 in accordance with the present disclosure. Other elements may be present between the insulation 14 and the backup wall 12 and between the insulation 14 and the rainscreen 16, such as condensation and waterproof barriers/films and the like. In addition, an air space may be present between the insulation 14 and the rainscreen 16.

Figure 5:
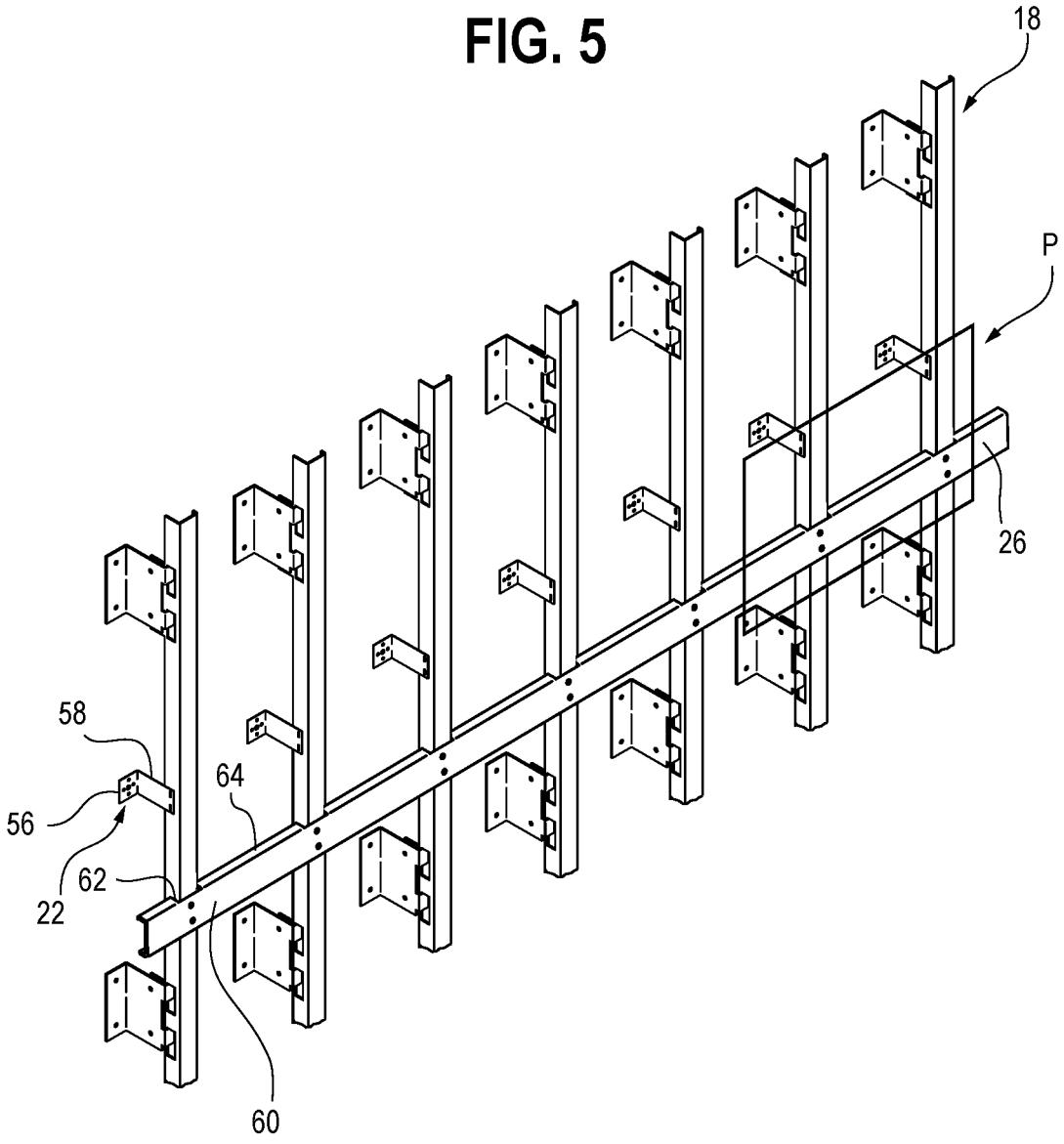
FIG. 5 is a perspective view of the rainscreen support system in isolation and shown with one horizontal support member.

As seen in FIGS. 1 and 5, the rainscreen support system 18 includes primary or backup wall brackets 20, secondary or fixed midspan brackets 22, adjustable vertical support members 24 and horizontal support members 26.

In a current embodiment, the backup wall brackets 20 include a baseplate or flange 28 that is mounted to the backup wall 12 or structure 10, a transverse or extension leg 30 that extends outwardly from and transverse to the baseplate 28, and fastening fingers 32 that extend from a distal end 34 of, and transverse to the extension leg 30. The fastening fingers 32 are generally parallel to the baseplate 28. The backup wall brackets 20 can be fixed backup wall brackets 20, fixed to the backup wall 12 at the baseplate 28.

Figure 3:
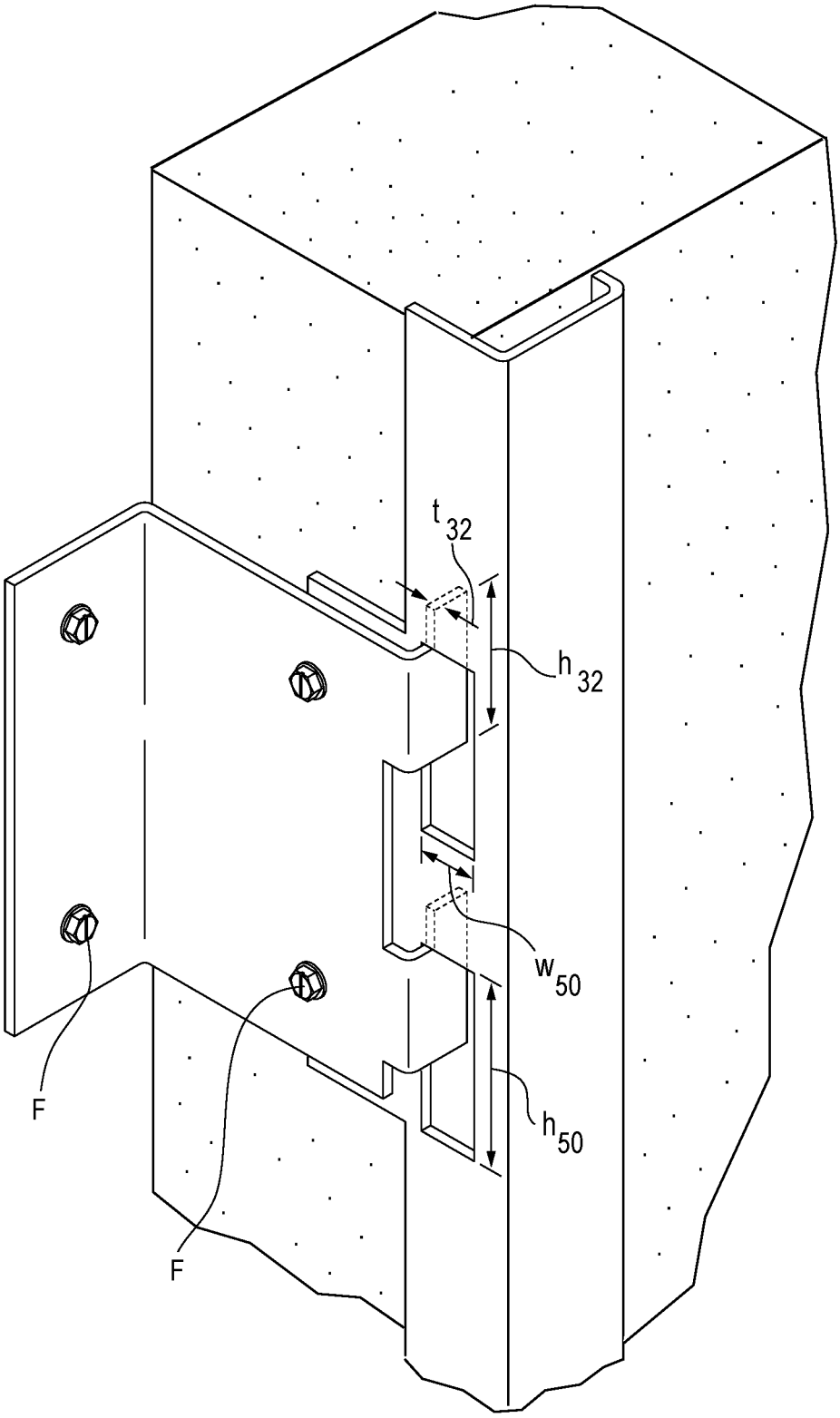
FIG. 3 is a partial enlarged view of the bracket and vertical support member as secured to one another with the vertical member at a first closest distance to the backup wall.

The fastening fingers 32 include a locking portion 36 at an end 38 thereof that extends upwardly from the fingers 32. In a current embodiment, the backup wall bracket 20 includes two fastening fingers 32 each with a locking portion 36 and the locking portions 36 are formed as integrally as upwardly extending lips. The backup wall bracket 20 can include one fastening finger 32 or multiple fastening fingers 32, all configurations of which are with the scope and spirit of the present disclosure. The baseplate 28 can include openings 40 to secure the backup wall bracket 20 to the backup wall 12 and/or structure 10. To facilitate installation, the extension leg 30 includes openings 42 therein for receiving fasteners, such as screws or bolts, as will be described below. As seen in FIG. 3, the fastening fingers 32 have a thickness $t_{32}$.

Figure 4:
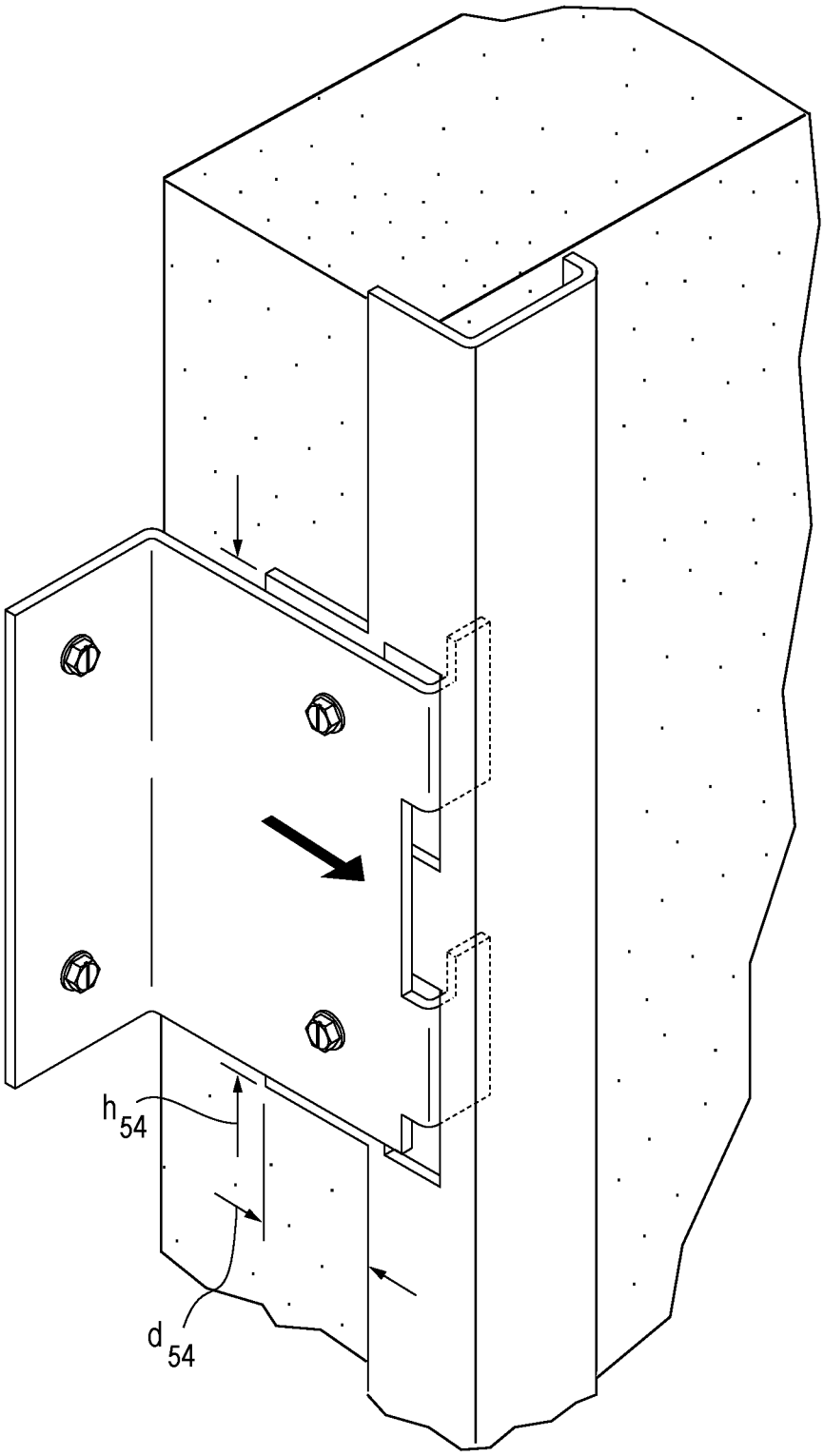
FIG. 4 is a view similar to FIG. 3 showing the vertical member secured to the bracket at a second spaced distance from the backup wall.

The adjustable vertical support members 24 are L-shaped members having a mounting leg 44 and a transverse or façade facing leg 46. The façade facing leg 46 can include an inwardly extending return bend 48 opposite the mounting leg 44. The return bend 48 provides structural strength and rigidity to the adjustable vertical support member 24 and serves to hold the insulation in place. As best seen in FIGS. 3 and 4, the adjustable vertical support member 24 includes openings 50 in the mounting leg 44 that correspond with and are configured to receive the fastening fingers 32. In a current embodiment the openings 50 are slotted openings. The slotted openings 50 have a height $h_{50}$ slightly larger than a height $h_{32}$ of the fastening fingers 32 and have a width $w_{50}$ larger than the thickness $t_{32}$ of the fastening fingers 32. The adjustable vertical support member 24 is installed on the fastening fingers 32 by positioning the adjustable vertical support member 24 onto the fastening fingers 32, through the slotted openings 50 and lowering the adjustable vertical support member 24 so that the upwardly extending locking portions 36 rest on an inner surface 52 of the mounting leg 44 above the slotted opening 50.

This configuration of narrower or thinner fastening finger 32 and larger width slotted opening 50 permits adjusting the position of the adjustable vertical support member 24 toward and away from the backup wall 12 or structure 10 as illustrated in FIGS. 3 and 4, in which in FIG. 3, the adjustable vertical support member 24 is at a greatest distance from the backup wall 12 or structure 10 and in FIG. 4 in which the adjustable vertical support member 24 is at a greatest distance from the backup wall 12 or structure 10. It will be appreciated that this novel interlocking configuration permits adjusting the distance between the rainscreen 16 and the backup wall 12 or structure 10 to accommodate different thicknesses of insulation 14 and also permits adjusting the position of the rainscreen 16 to accommodate irregularities in the surface of the backup wall 12 or structure 10.

In order to affix the position of the adjustable vertical support member 24 to the backup wall bracket 20, the adjustable vertical support member 24 includes a tab or flange 54 on the mounting leg 44 the extends rearwardly (toward the backup wall 12 or structure 10). The height $h_{54}$ of the tab 54 extends from about a top of an upper slotted opening 50 to a bottom of an adjacent lower slotted opening 50 as best seen in FIG. 3. The tab 54 is sufficiently deep $d_{54}$ so that regardless of where the adjustable vertical support member 24 is positioned away from or toward the backup wall 12 or structure 10 (e.g., as seen in FIGS. 3 and 4), fasteners F can be positioned in the backup wall bracket openings 42 and into the adjustable vertical member tab 54.

The fixed midspan brackets 22, best seen in FIGS. 1 and 5 include a base plate 56 and an extension leg 58. The fixed midspan brackets 22 can be installed, by fasteners F, to the backup wall 12 or structure 10 and to the adjustable vertical support members 24 once the adjustable vertical support members 24 are fixed in place at the backup wall brackets 20.

FIG. 5 illustrates the rainscreen support system 18 with multiple adjustable vertical support members 24 and one horizontal support member 26. The horizontal support member 26 extends along all or some of the adjustable vertical support member 24. In an embodiment, the horizontal support members 26 are C-shaped channels. Other suitable structural shapes will be recognized by those skilled in the art. Only one horizontal support member 26 is shown for ease of illustration, but it will be understood that multiple horizontal support members 26 can be used in the system 18.

To mount the horizontal support members 26 to the adjustable vertical support members 24 such that an outer surface 60 of the horizontal support members 26 are flush or near flush with the transverse or façade facing leg 46 of the adjustable vertical support members 24, the horizontal support members 26 have cut-outs 62 in the legs 64 of the C-shaped channel. In this manner, when the horizontal support members 26 are fastened to the adjustable vertical support members 24, their outermost faces (the outer surface 60 of the horizontal support members 26 and the façade facing leg 46 of the adjustable vertical support members 24) are flush or near flush with one another; in other words, the outer surface 60 of the horizontal support members 26 and the façade facing leg 46 of the adjustable vertical support members 24 can define one or more planes P (see, FIG. 5).

In a current embodiment, the backup wall and fixed midspan brackets 20, 22 are 12-gauge (ga. thick) stainless steel and the slotted openings 50 in the vertical support members 24 have a width $w_{50}$ of about ¾ inch to allow for the depth (in/out) adjustment of the vertical support members 24 and a height $h_{50}$ of about 2½ inches. The vertical and horizontal support members 24, 26 are formed from 12 ga. aluminum. The vertical support member tab 54 is about 6½ inches long ($h_{54}$) and about 1½ inch deep ($d_{54}$) to permit securing the vertical support member 24 to the backup wall bracket 20 at the tab 54. Other bracket 20, 22 and member 24. 26 materials and sizes will be recognized by those skilled in the art and are within the spirit and scope of the present disclosure.

In the present disclosure, the words "a" or "an" are to be taken to include both the singular and the plural. Conversely, any reference to plural items shall, where appropriate, include the singular. All percentages are percentages by weight, unless otherwise noted.

All patents and published applications referred to herein are incorporated by reference in their entirety, whether or not specifically done so within the text of this disclosure.

It will also be appreciated by those skilled in the art that the relative directional terms such as sides, upper, lower, top, bottom, rearward, forward and the like are for explanatory purposes only and are not intended to limit the scope of the disclosure.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A rainscreen support system for supporting a rainscreen on a wall structure, the wall structure having a backup wall, the rainscreen support system comprising:

a pair of backup wall brackets, the backup wall brackets having a baseplate mountable to the backup wall, an extension leg extending outwardly from and transverse to the baseplate, each of the backup wall brackets having a fastening finger extending from a distal end thereof transverse to the extension leg, the fastening finger being generally parallel to the baseplate and further comprising a locking portion extending vertically upward therefrom, the locking portion horizontally spaced from the extension leg by the fastening finger;

an adjustable vertical support member having a mounting leg and a transverse leg, the mounting leg having openings therein that correspond with and are configured to receive the fastening fingers and locking portions therethrough, each opening defines an upper interior surface thereof which rests on a respective fastening finger with the mounting leg positioned between the extension leg and the locking portion;

wherein the vertical support member is adjustable toward and away from the backup wall bracket baseplate to adjust a distance between the vertical support member and the backup wall.

2. The rainscreen support system of claim 1, wherein the mounting leg comprises an inner surface that contacts the locking portion and an outer surface that contacts the extension leg.

3. The rainscreen support system of claim 1, wherein the mounting leg has an interior edge opposite the transverse leg, and further includes tabs extending from the interior edge away from the transverse leg along a portion of respective extension legs.

4. The rainscreen support system of claim 3, wherein the extension legs each include a fastener opening therein for receiving a fastener therethrough into a respective tab to secure the vertical support member to the backup wall brackets at a desired distance between the adjustable vertical support member and the baseplates.

5. The rainscreen support system of claim 1, wherein each backup wall bracket includes two fastening fingers.

6. The rainscreen support system of claim 1, wherein the pair of backup wall brackets is a first pair of wall brackets and wherein the adjustable vertical support member is a first adjustable vertical support member and further including a second pair of backup wall brackets and a second adjustable vertical support member, the second pair of backup wall brackets and the second adjustable vertical support member spaced from the first pair of backup wall brackets and the first adjustable vertical support member.

7. The rainscreen support system of claim 6, further including a horizontal support member extending between the first and second adjustable vertical support members.

8. The rainscreen support system of claim 7, wherein the horizontal support member includes cut-outs at the juncture of the horizontal support member and the first and second adjustable vertical support members.

9. The rainscreen support system of claim 6, wherein the horizontal support member is a C-shaped channel.

10. The rainscreen support system of claim 1, wherein the transverse leg includes a return bend at an end thereof.

11. The rainscreen support system of claim 1, further including a midspan bracket having a base plate and an extension leg.

12. The rainscreen support system of claim 11 wherein the fixed midspan bracket is positioned between the pair of backup wall brackets and is fastened to the adjustable vertical support member on the extension leg.

13. The rainscreen support system of claim 8, further including a third pair of support brackets and a third adjustable vertical support member, the third pair of backup wall brackets and the third adjustable vertical support member spaced from the second pair of backup wall brackets and the second adjustable vertical support member, and wherein the horizontal support member extends across the first, second and third adjustable vertical support members.

14. The rainscreen support system of claim 13, wherein the horizontal support member is a first horizontal support member and further including a second horizontal support member extending across at least some of the first, second and third adjustable vertical support members and spaced from the first horizontal support member.

15. The rainscreen support system of claim 6, wherein the adjustable vertical support members are affixed to their respective backup wall brackets to accommodate insulation between the adjustable vertical support members and the backup wall.

16. The rainscreen support system of claim 6, wherein the adjustable vertical support members are fastenable to the backup wall brackets over a range of distances between the adjustable vertical support member transverse leg and the backup wall bracket baseplate.

* * * * *